United States Patent [19]

Gaboardi

[11] 4,367,962

[45] Jan. 11, 1983

[54] MOSAIC PRINTING HEAD

[75] Inventor: Angelo Gaboardi, Pregnana Milanese, Italy

[73] Assignee: Honeywell Information Systems Inc., Waltham, Mass.

[21] Appl. No.: 240,042

[22] Filed: Mar. 3, 1981

[30] Foreign Application Priority Data

Feb. 18, 1980 [IT] Italy ..... 20717 A/80

[51] Int. Cl.[3] ..... B41J 3/12

[52] U.S. Cl. ..... 400/124; 101/93.05

[58] Field of Search ..... 400/124; 101/93.05

[56] References Cited

U.S. PATENT DOCUMENTS 4,140,406 2/1979 Wolf et al. ..... 400/124

4,260,270 4/1981 Cavallari ..... 400/124

*Primary Examiner*—Paul T. Sewell

*Attorney, Agent, or Firm*—George Grayson; Nicholas Prasinos

[57] ABSTRACT

A mosaic printing head for use in a computer printer includes a needle guiding assembly and an electromagnet assembly for activating the needles. The printer head utilizes a unique design to provide for simple and fast adjustment of the position of each printing needle while eliminating any effect on the adjustment because of vibrations occurring during the printing. This design allows the needle stroke to be adjusted so as to achieve very high speed printing operation.

2 Claims, 9 Drawing Figures

MOSAIC PRINTING HEAD

BACKGROUND OF THE INVENTION

1. Field of the Invention

This invention relates to an improved mosaic or matrix print head. Such a print head generally includes a needle guide assembly and a plurality of electromagnetic structures coupled to the guide assembly. Each electromagnetic structure is mounted on an electromagnetic support and comprises a magnetic circuit formed by two pole pieces connected by a yoke and by a movable armature which completes the magnetic circuit. It further includes at least a coil wound around one of the two pole pieces.

2. Description of the Prior Art

Examples of mosaic or matrix print heads are given in U.S. Pat. No. 4,051,941, British Pat. No. 1,447,661 and U.S. patent application Ser. No. 74,264 filed by the same applicant. It should be noted that each of the electromagnetic structures acts as an activator for one of the printing needles. Furthermore, each movable armature is provided with at least an arm which protrudes externally to the electromagnetic structure and operates as an actuating arm for the associated needle. The needles are generally mounted on a carriage which is moveable along the printing line, in order to execute the serial printing of characters.

Mosaic print heads must be very inexpensive and simple in construction. At the same time they must allow for precise adjustment, in particular of the air gap width in the electromagnetic structure with the armature in the rest position and therefore the stroke of the associated printing needles. Such needle stroke adjustment is essential in order to achieve a very high operation frequency because the maximum attainable frequency is greatly influenced and limited by such stroke. In the previously identified U.S. patent application, a mosaic printing head is described where the adjustment of the electromagnetic gaps in the rest position is performed in a collective manner. In such case, however, it is not possible to adjust for the differences of the working tolerances of both needles and electromagnetic structures. As a result, this leads to stroke values very different for the several printing needles which create a defective type formation that becomes even more objectionable as the printing speed is increased. In fact, in a very fast matrix printing head if each needle has a different stroke, the transversal printing line corresponding to the seven needle line will not be perfectly aligned because the impact of the different needles against the printing support will not be simultaneous owing to the different strokes of the printing needles. Therefore, for very high printing speeds, it is essential that there be provided individual rest air gap adjustments for each electromagnetic structure and its respective needle. A solution of this kind is described in the English Pat. No. 1,477,661 but the head resulting from it is complex and expensive, and it requires a long time for the set up of each printing needle stroke.

Italian Pat. No. 956,585 describes a wire matrix print head where such adjustments can be individually performed on each electromagnetic structure and related needle. However, such print head is complex and expensive. In contrast, the number of constructive elements and constructive complexity are reduced to a minimum in the print head disclosed in U.S. Pat. No. 4,051,941 at the expense of adjustability and calibration.

Another solution of such kind is described in the French Patent Publication No. 7440815, wherein a reduced number of components and constructive simplicity are stressed. However, this design approach is not useful because it can not prevent the adverse vibration effects on the air gap adjustments.

SUMMARY OF THE INVENTION

The applicant's printing head overcomes such problems and inconvenience. The invention utilizes great structure simplicity in order to enable a simple and fast adjustment of each electromagnet air gap in the rest position while eliminating any effect on the adjusting element produced by the vibrations occurring during the printing.

The disadvantages of the prior art are overcome by the printing head of the present invention where the structure is remarkably simple and inexpensive, but it also contains provisions for precise air gap adjustment of the electromagnet structure, particularly in the rest position. This allows for high quality printing at very high speeds.

BRIEF DESCRIPTION OF THE DRAWINGS

These and other features will appear more clearly from the following description of a preferred form of the invention and from the accompanying drawings where.

DESCRIPTION OF THE PREFERRED EMBODIMENT

Figure 1:
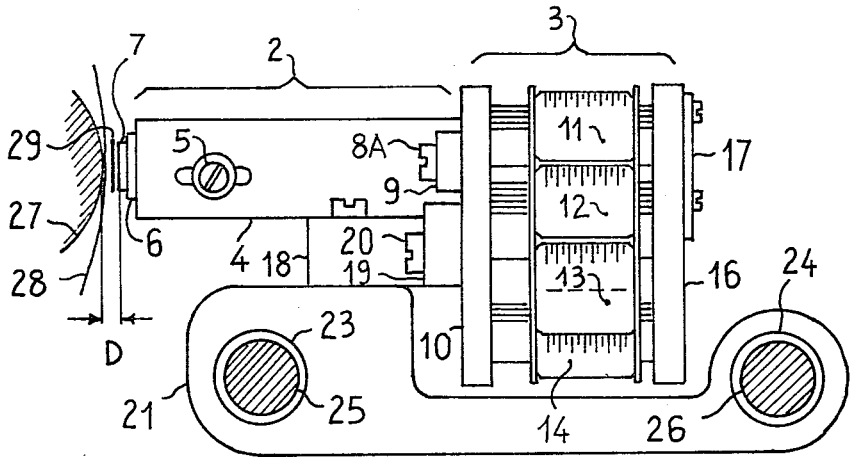
FIG. 1 is a side view of a printing head according to the invention.

Referring to FIG. 1, it shows in side view a print head according to the invention comprising a needle guiding assembly 2 and an electromagnet assembly 3. The needle guiding assembly comprises a frame 4 having a bracket 6, fixed to the frame by a screw 5, which supports a guide for the printing ends of the needles, the guide being generally formed by a pair of suitably-shaped ruby plates 7.

The needle guiding assembly 2 is fixed to the electromagnetic assembly 3 by means of two screws (in FIG. 1 the head 8A of one of such screws is visible) which lock two brackets 9 and 43 formed on the sides of frame 4 against the electromagnetic assembly 3. The electromagnetic assembly 3 comprises a supporting disk 10, to which a suitable number of electromagnets, such as 11, 12, 13, 14 are fixed, an internal bushing (not visible) fixed by calking or shrinkage in a central opening of disk 10, an armature retainer 16 and a central cap 17.

A socket 18, provided with two side brackets 19, is fixed by screws 20 to the electromagnetic supporting disk 10. For purposes of easier manufacturing of the elements, such socket is separate from disk 10, but it could be integral to disk 10. In turn, socket 18, and as a consequence the whole printing head, is fixed to a print carriage 21 by means of screws 22.

The printing carriage is provided with driving bushings 23, 24 inserted onto two parallel guiding bars 25 and 26, so that the carriage and therefore the print head may slide in the direction of said bars, perpendicular to the plane of the drawing. The carriage and guiding bars are part of the printer frame, which is not shown.

In FIG. 1 it can be seen that the external surface of the ruby plates 7 is placed at a distance D from a platen 27. A paper printing support member 28 and an inked ribbon 29 are interposed between platen 27 and ruby plates 7. Distance D must be suitably adjusted to leave a certain allowance between platen 27 and the print head, but at the same time it must be kept to a minimum in order to keep to a minimum the stroke of the printing needles. A high operating speed of the printer is obtained only if the stroke of the needles is minimum. At the same time the end of the needles at rest must not protrude beyond the rubies because it would cause needle wear and considerable wear of the inked ribbon.

Figure 2:
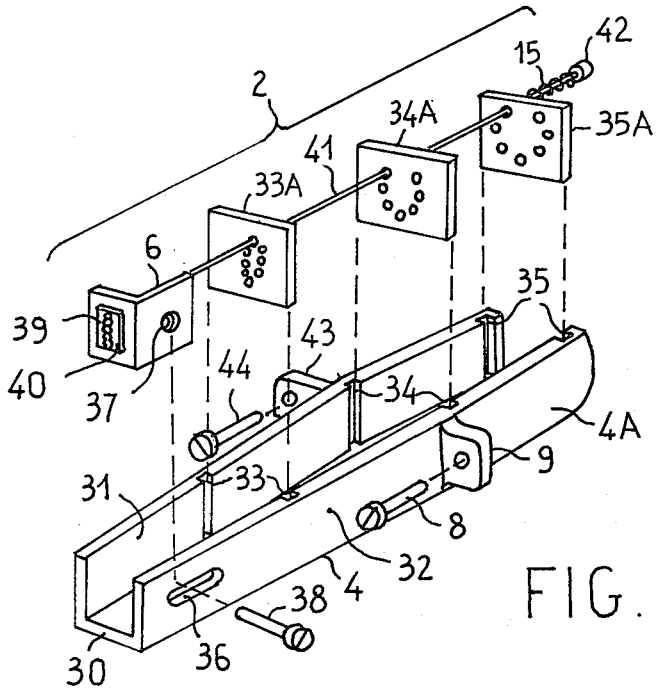
FIG. 2 is a perspective, exploded view of the elements which form a needle guiding assembly of the printing head according to the invention.

FIG. 2 shows in perspective exploded view and with greater detail the needle guiding assembly 2. The needle guiding assembly 2 comprises a frame or elongated body 4 having a generally C-shaped section which is tapered towards one end 30 where bracket 6 is mounted. Such frame which is opened in the upper side as shown in FIG. 2 (but alternatively it could be open on the lower side) may be obtained by casting or preferably by plastic molding.

Internally to frame 4, on sides 31 and 32 there is a certain number of vertical grooves 33, 34, 35. Such grooves are to receive needle guiding diaphragms 33A, 34A, 35A. One side 32 of the frame (but alternatively the other one or the bottom even) has an elongated opening 36 intended to receive a locking screw 38 engaging with a threaded seat 37 of bracket 6. Opening 36 is elongated in a direction perpendicular to the plane of impression so that bracket 6 may be fixed to frame 4 at a variable and adjustable distance from the platen.

Each of the diaphragms 33A, 34A, 35A is provided with a number of openings equal to the number of needles to be driven with the openings being disposed over a suitable area of the diaphragms as illustrated. The closer the diaphragms are to end 30 of a body 4 the closer the openings approximate a vertical distribution.

Guiding member or plate 7 consists of two rubies 39 and 40 having a vertical slot in which the needles are inserted and guided in vertical alignment.

In FIG. 2 one needle 41 only is shown with a head 42. For each needle a compression spring 15 is inserted between the needle head 42 and diaphragm 35A. The springs tend to keep the needles in a rest, retracted position and the heads apart from the diaphragm.

Frame 4 is provided on the sides with two brackets 9, 43, each having an opening for receiving two screws 8, 44 respectively. Screws 8, 44 are used to fix the guide assembly 4 to the electromagnet assembly 3. On the opposite end of where bracket 6 is mounted, frame 4 extends beyond brackets 9, 43 with an appendix 4A, preferably with an externally cylindrical shape. This appendix fits in a corresponding central opening of the electromagnet supporting side 10 and internally to a bushing which is part of the electromagnetic assembly 3.

Figure 3:
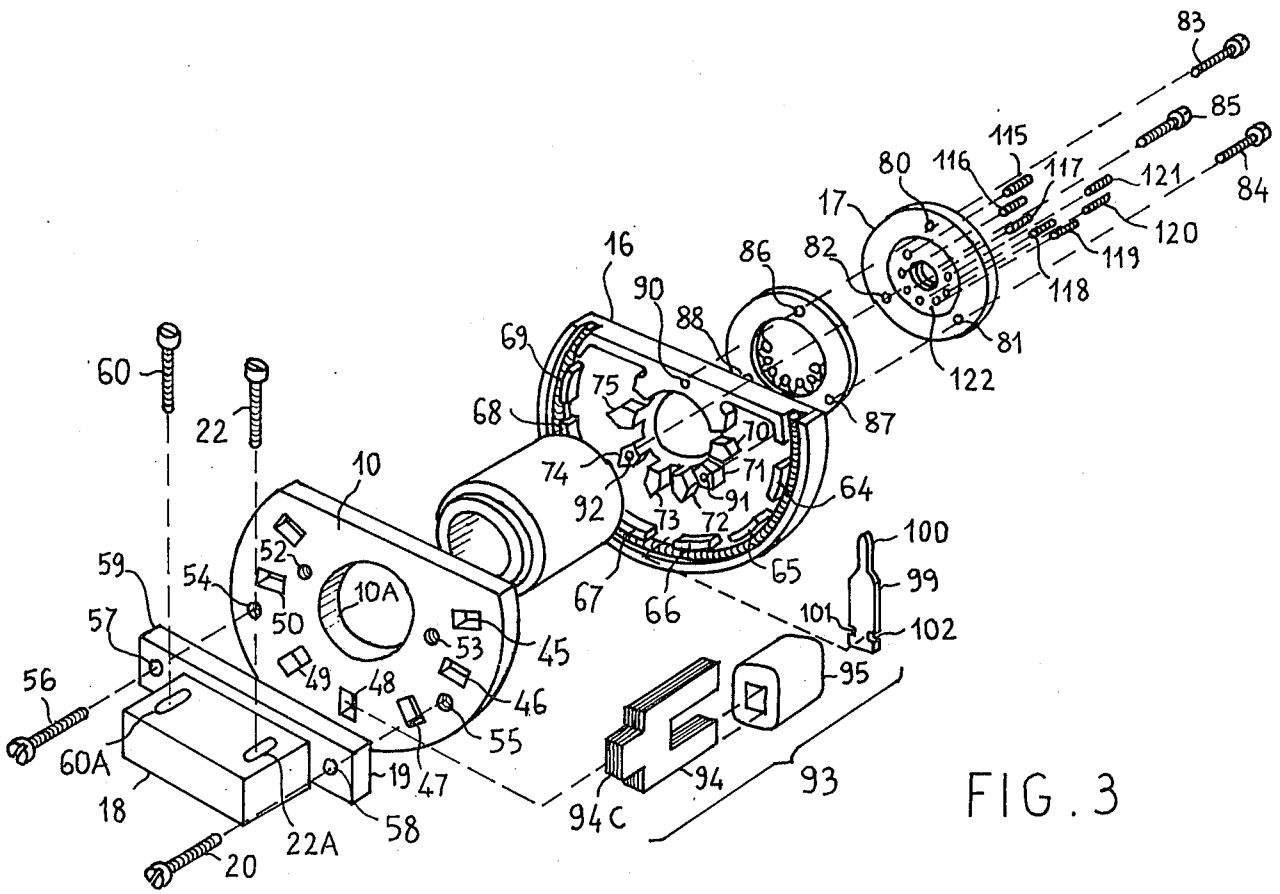
FIG. 3 is a perspective, exploded view of the elements which form an electromagnetic assembly of the printing head according to the invention.

FIG. 3 shows in perspective exploded view an electromagnet assembly 3. The electromagnet supporting disk 10 consists of a ring-shaped member in the form of circular segments having a central round opening 10A. It contains a suitable number of rectangular openings 45–51, each of which receives an appendix provided in each magnetic core. The openings 45–51 are radially distributed around the disk center and uniformly spaced in a convenient circular sector of the disk 10. Two threaded openings 52, 53 enable screws 44 and 8 (FIG. 2) to engage in said openings and to fix the guiding assembly 2 to the electromagnet assembly. Two other threaded openings 54 and 55 receive screws 56 and 20, which by previous insertion in openings 57, 58 provided in brackets 59 and 19 or socket 18, connect together socket 18 and supporting disk 10.

Socket 18 is provided with two openings 60A, 22A, elongated in the direction perpendicular to the plane of impression and adapted to receive screws 60 and 22 which are screwed in suitable threaded seats of the printing carriage. Thus socket 18 (and the whole print head) is fixed to the printing carriage and allows for adjustment of the print head distance from the platen 27.

A cylindrical bushing 61 is fixed by shrinking or calking in the central opening 10A of the supporting disk 10. An armature retainer 16 is placed on the bushing plane surface opposite to the bushing end which is fixed to the disk 10.

Figure 7:
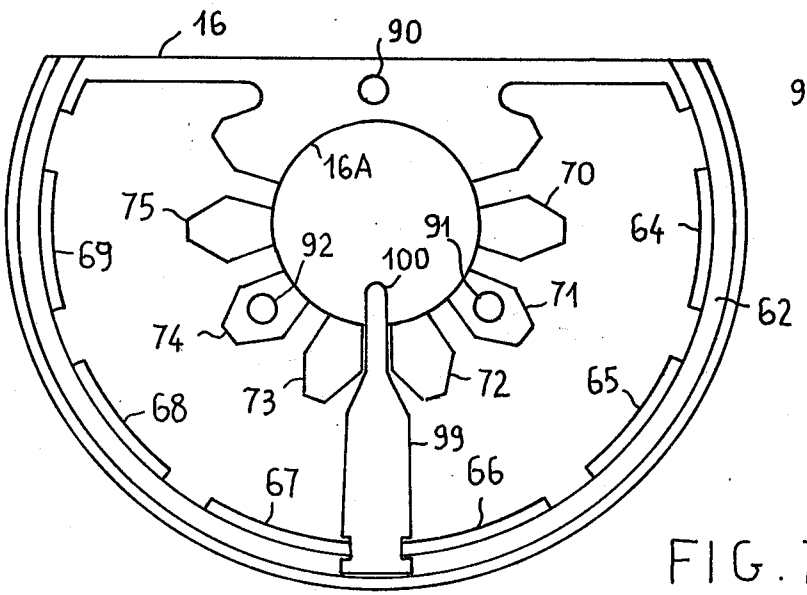
FIG. 7 is a front view of the inner side of the armature retainer used in the electromagnetic assembly.

Retainer 16 has substantially the same shape as disk 10, that is a ring shaped element in the form of a circular segment with a central opening 16A. As shown in FIG. 7, the peripheral portion of retainer 16 is provided with a groove 62 receiving a resilient member such as string 63. String 63 may be a rubber string with round section. Along the groove 62, retainer 16 is provided with posts 64, 65, 66, 67, 68, 69 which interpose between adjacent armatures and impose a radial distribution of the armatures. Similar posts 70, 71, 72, 73, 74, 75 are provided internally at the periphery of the central opening, with the double function of imposing a radial distribution of the armature and providing retainer 16 with a contact face to bushing 61. Retainer 16 is fixed to bushing 61 by means of ring-shaped adjusting disc or cap 17.

FIG. 3 shows that a plurality of electromagnets are to be mounted in the electromagnet group, but only a single electromagnet 92 is shown. Electromagnet 93 includes a magnetic core 94 which is formed by a pack of generally U-shaped magnetic sheets and having an appendix 94C for insertion in one of the rectangular openings of disk 10, for instance opening 48. A coil 95 is wound around a column of the magnetic core 94 and the magnetic circuit is closed by a movable armature 99. The armature 99 has an extension arm 100 operating as a lever arm for the actuation of a needle. The extension arm 100 is inserted between two internal posts 72, 73 of the retainer 16 (see also FIG. 7). Opposite arm 100, the armature is provided with two grooves 101, 102 which receive the side portion of two adjacent external posts of the retainer 16, for instance posts 66, 67 of FIGS. 3, 7. In this way, armature 99 and the other like armatures of the electromagnet group are precisely positioned in their respective seats in retainer 16.

Cap 17 has a suitable number of openings distributed circumferentially on its peripheral portion. Preferably three openings 80, 81, 82 are used. Each opening receives a screw, 83, 84, 85 which is screwed into a corresponding threaded seat of bushing 61. The screws are inserted in the three openings 86, 87, 88 in a resilient ring 89, which is interposed between cap 17 and armature retainer 16, as well as in the three openings 90, 91, 92 (FIG. 7) in the armature retainer, in correspondence with three internal posts.

Figure 4A:
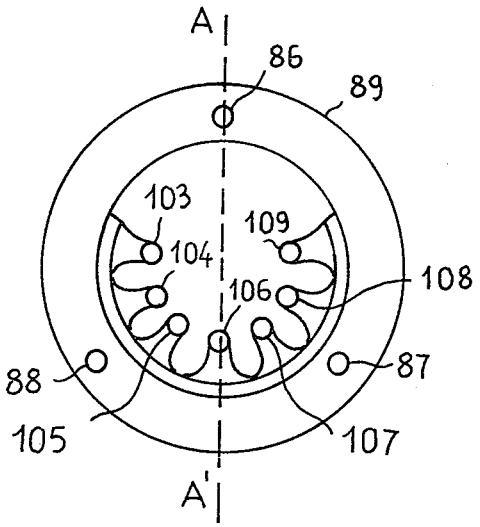
FIG. 4*a* is a front view and FIG. 4*b* is a section view of the resilient ring of the electromagnetic assembly.
Figure 4B:
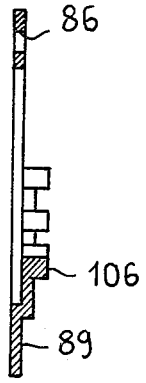

The resilient ring 89, whose frontal view is shown in FIG. 4*a* and whose section view, according to plane AA' is shown in FIG. 4*b*, is provided, internally, with 7 projections 103, 104, . . . 109. These projections extend in the central opening 16A of armature retainer 16 and define the rest position of the electromagnet armatures (e.g. 99). These projections further act as rebounding dampers of the armature stroke when they return to the rest position. The thickness of the projections, as shown in FIG. 4*b*, is suitably greater than the thickness of the resilient ring 89 in order to enhance this damping effect.

Each projection is supported from the opposition and by an adjusting screws 115, 116, . . . , 121 respectively. These screws are housed in threaded seats of cap 17 as clearly shown in FIG. 6.

Figure 5A:
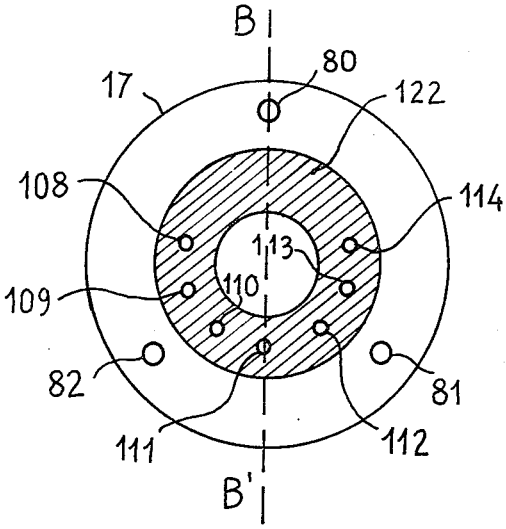
FIG. 5*a* is a front view and FIG. 5*b* is a section view of the adjusting disk of the electromagnetic assembly.
Figure 5B:
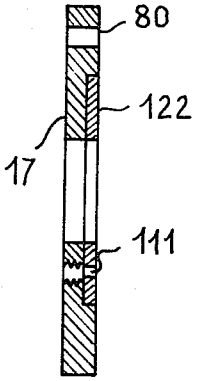

Adjusting disc of cap 17, whose front view is shown in FIG. 5*a* and whose section view according to plane BB' is shown in FIG. 5*b*, has on the inner part of one face a circular recess where a rubber ring 122 of suitable hardness is vulcanized. Cap 17 and rubber ring 122 are provided with openings numbered, from 108 to 114, located in correspondence to projections 103, 104, . . . 109 of the resilient ring 89 and receiving screws 115, . . . 121. Such openings are threaded internally to cap 17 but not inside the rubber ring where their diameter is equal to the internal or minimum threading diameter (See FIG. 5*b*). This is obtained with no difficulties as the threading instrument does not bite the resilient material of ring 122.

Figure 6:
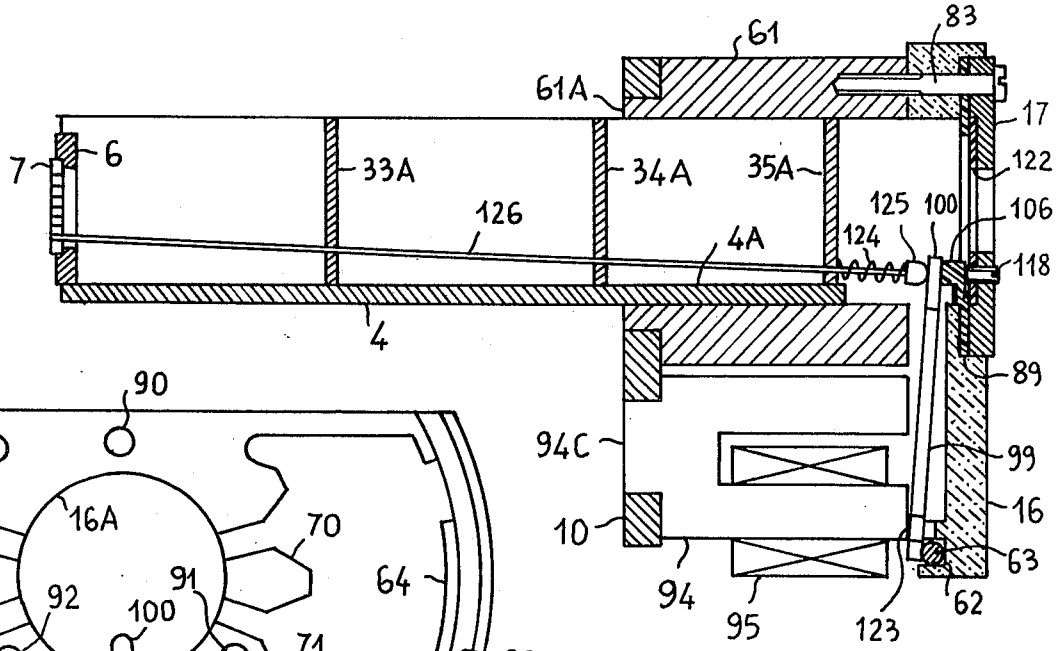
FIG. 6 is a medium, side section view of the printing head according to the invention.

As shown in FIG. 6, the adjusting screws extend beyond rubber ring 122 and adjust the position of projections 103, 104 . . . 109, and consequently the position of the armature and the width of the magnetic circuit air gap. With this embodiment, a force exerted by rubber ring 122 is always acting on the adjusting screws. The direction of such force coincides with the threaded openings axis while its sense opposes the advancement of the screw. In such a way any movement between screw and nut thread is prevented owing to the interference between screw and opening in the vulcanized rubber; the force exerted by the vulcanized rubber ring is caused by the steady contact between screw and nut thread.

The whole assembly and the function of the several elements appears more clearly from FIG. 6 which is a median section view of the printing head taken from the same point of view of FIG. 1.

FIG. 6 shows clearly a section of the needle guiding assembly with frame 4, needle guide bracket 6, needle guide 7 and diaphragms 33A, 34A, 35A. Appendix 4A of the frame is inserted in bushing 61 which in turn has its end portion 61A inserted in the central opening of supporting disk 10 forming a unitary member. Disk 10 has openings for the mounting of the electromagnets. In FIG. 6 an opening is shown which receives appendix 94C of magnetic core 94. A coil 95 is wound around one of the columns of magnetic core 94 and preferably for avoiding encumbrance problems, on the external one, having in mind the radial mounting of the electromagnets.

In FIG. 6, the armature 99 associated with magnetic core 94 is shown and lays on the core at point 123 of the air gap and is kept in contact with the core by resilient string 63 inserted in groove 62 of retainer 16.

As shown in FIG. 7, the radial position of the armature 99 in the assembly is provided by posts 67, 66 inserted in two symmetrical notches formed in the armature sides, and by the two internal posts 72, 73. Clearly, the other armatures, not shown in the drawings, are retained in an identical way. In FIG. 6 it is shown that with reference to the inner column of core 94, armature 99 is kept away from the magnetic pole by the combined effect of the spring 124 action on the head 125 of needle 125 which engages arm 100 of the armature, as well as the effect of the resilient string 62 on the opposite end of the armature 99. The rest position of the armature 99 is defined by projection 106 of resilient ring 89, and by the corresponding screw 118 of cap 17. Other armatures not shown are retained in the rest position in an identical way. As shown in FIG. 6, retainer 16 is firmly pressed against the bushing 61 by cap 17. Since the cap 17 is fixed to the bushing 61 by means of a plurality of screws (in FIG. 6 screw 83 is shown), the armature retainer 16 is firmly pressed against the bushing 61. In addition, since a resilient ring 89 is interposed between cap 17 and armature retainer 16, the projections are inserted in the central opening of armature 16. An adjusting screw on cap 17 corresponds to each projection. The advancement or the regression of each adjusting screw varies the rest distance of the associated armature from the magnetic pole. The rubber ring 122 vulcanized on cap 17 provides a high dynamical stability of the adjusting screws.

With the armature adjusting system described in the present invention, the calibration of the needle stroke is both easy and fast. In fact the calibration is made on the inspection bench by lining up the needle bits to a vertical reference line by means of optical devices. The necessary calibrations are performed by acting on the appropriate adjusting screws. Alternatively, a calibration can be made on inspection bench as to the actuation time of the several needles by detecting the impact times by means of a piezoelectric transducer and thereafter acting on the appropriate screws of the several needles in order to equalize their impact times.

I claim:

1. A mosaic printing head adapted to be mounted on a printing carriage for providing an impression against a platen, including a needle guiding assembly having a plurality of needles and an electromagnet assembly:

said electromagnet assembly comprising a plurality of electromagnetic structures radially distributed on a circular segment of a supporting ring member, each of said plurality of electromagnetic structures including a pole piece and an armature;

said armature having a lever arm acting on one of said plurality of needles to drive said needle towards the platen;

armature adjusting means, said armature adjusting means including an armature retainer, a resilient ring and an adjusting disc;

said retainer, said resilient ring and said adjusting disc cooperating to secure each of said armatures in a preferred rest position;

said adjusting disc for adjusting the rest position of each of said armature housing a plurality of adjusting screws, one for each armature, said resilient ring been interposed between said armature retainer and said adjusting disc;

said resilient ring including a plurality of inner projections, each one of said projections being in contact with one of said lever arm on one side and being adjusted in position by one of said adjusting screws from the opposite side, and wherein said projections have a thickness greater than the thickness of said resilient ring and act as a damping element for said armature, whereby the rest position of said armatures is individually defined and adjusted by said adjusting screws, through said projections, and rebound of said armature is dampened by said projections of said resilient ring.

2. A mosaic printing head adapted to be mounted on a printing carriage for providing an impression against a platen, including a needle guiding assembly having a plurality of needles and an electromagnet assembly:

said electromagnet assembly comprising a plurality of electromagnetic structures radially distributed on a circular segment of a supporting ring member;

each of said plurality of electromagnetic structures including a pole piece and an armature, said armature having a lever arm acting on one of said plurality of needles to drive said needle towards the platen;

armature adjusting means, said armature adjusting means including an armature retainer, a resilient ring and an adjusting disc;

said retainer, said resilient ring and said adjusting disc cooperating to secure each of said armatures in a preferred rest position;

said adjusting disc for adjusting the rest position of each of said armature housing a plurality of adjusting screws, one for each armature, in a corresponding threaded seat, and being provided with a rubber ring vulcanized on one side of said adjusting disc the rubber ring having openings, aligned with said threaded seat and having a diameter smaller than the external diameter of said threaded seats, each of said adjusting screws being frictionally inserted in one of said openings;

said resilient ring being interposed between said armature retainer and said adjusting disc, said resilient ring including a plurality of inner projections, each one of said projections being in contact with one of said lever arm on one side and being adjusted in position by one of said adjusting screws from the opposite side whereby any axial movement of said adjusting screws due to vibration and slack is eliminated by the frictional forces applied by said rubber ring to said adjusting screws.

* * * * *